US005984086A

United States Patent [19]

Foushee et al.

[11] Patent Number: 5,984,086

[45] Date of Patent: Nov. 16, 1999

[54] WRAP PACKAGE

[75] Inventors: Fred S. Foushee, Suwanee; Frank Crutchley, Norcross, both of Ga.

[73] Assignee: Rock Tenn Company, Norcross, Ga.

[21] Appl. No.: 09/251,831

[22] Filed: Feb. 17, 1999

[51] Int. Cl.[6] ..... B65D 75/00

[52] U.S. Cl. ..... 206/147; 206/196; 206/199

[58] Field of Search ..... 206/145, 147, 206/151, 156, 157, 160, 161, 183, 187, 194, 196, 199, 427; 53/398, 443

[56] References Cited

U.S. PATENT DOCUMENTS

| | | | |
|---|---|---|---|
| 2,737,326 | 3/1956 | Toensmeier | 224/45 |
| 3,166,190 | 1/1965 | Corades | 206/196 |
| 3,245,711 | 4/1966 | Dantoin | 294/87.2 |
| 3,612,266 | 10/1971 | Graser | 206/65 |
| 4,756,419 | 7/1988 | Le Bras | 206/196 |
| 5,201,412 | 4/1993 | Schuster et al. | 206/153 |
| 5,310,051 | 5/1994 | Sutherland | 206/153 |
| 5,351,817 | 10/1994 | Sutherland | 206/153 |
| 5,355,999 | 10/1994 | Sutherland | 206/153 |
| 5,638,956 | 6/1997 | Sutherland | 206/160 X |

*Primary Examiner*—Jacob K. Ackun
*Attorney, Agent, or Firm*—Schwegman, Lundberg, Woessner & Kluth PA

[57] ABSTRACT

A wrap package and method for making the package are disclosed. The wrap permits the packaging of a plurality of containers in an array of two or more rows. The wrap includes a top panel, side panels, and end panels all of which provide adequate area for product markings. The wrap is adapted to hold the containers in close proximity while preventing contact therebetween. The wrap package provides adequate package rigidity to support a plurality of containers packaged in any number of rows.

49 Claims, 9 Drawing Sheets

WRAP PACKAGE

TECHNICAL FIELD

This invention relates generally to a package and method of making a package for shipping and carrying a plurality of containers and, more particularly, to a folding paperboard wrap package for food containers.

BACKGROUND OF THE INVENTION

Paperboard packages for carrying containers are known in the food packaging industry. These carriers typically support multiple containers during shipping and shelf display and provide a convenient carrying means for the consumer. While many types of packages are available, they generally fall into one of two categories. In the first category are box-type packages such as those commonly used to package twelve-packs of beverage containers and the like. Box carriers completely enclose the containers and rely on contact between adjacent containers to prevent excessive motion within the package.

Another type of package is a wrap carrier. Wrap carriers surround only a portion of the containers such that another portion remains visible. Wrap carriers are advantageous over box-type carriers in several respects. One advantage is that they require less material to produce. In addition, wrap carriers permit the manufacturer to display a portion of the container itself, potentially improving product recognition. The present invention relates to wrap carrier packages or "wrap packages" and the remainder of this discussion will focus on the same.

While wrap packages are advantageous in many respects, drawbacks do exist. One such drawback is that wrap packages may often lack the structural rigidity and stiffness of box packages. Package manufacturers have addressed this problem in various ways. For example, some packages compensate for this problem by relying on the interrelation of the containers themselves to partially support the package. Another solution is to limit wrap packaging to use with lighter containers or to packages comprising fewer containers. Alternatively, the wrap package may include a stiffening apparatus to provide additional support to the package and containers. For example, see U.S. Pat. Nos. 5,201,412 to Schuster et al., and 5,310,051 to Sutherland. While these references address package rigidity, problems remain. For instance, these packages permit only a limited area on the package sides for product markings/indicia. As a matter of fact, some permit marking only on the top surface of the wrap. This is disadvantageous since the top of the package is typically covered in a stacked shelf display.

Another drawback of these wrap packages is that the containers are supported only at a top end. Accordingly, the containers may easily contact and rub against each other. While this is not a serious problem with aluminum containers, constant rubbing between plastic containers may damage the graphics printed thereon and may possibly lead to container rupture.

One wrap that seeks to address these shortcomings is shown in U.S. Pat. No. 3,612,266 to Graser. While Graser provides improved container support, it also introduces additional problems. In particular, the crown support feature of the Graser package is complex and hampers container removal. In addition, Graser lacks space for product markings on the package ends. Furthermore, the Graser package requires that each container have a crown or flange.

Accordingly, what is needed is a wrap package for containers that provides the rigidity to support multiple containers without permitting contact between the containers. What is further needed is a wrap package that permits markings to be placed on various portions of the package wherein the markings are visible from all sides. What is further needed is a wrap package that is inexpensive to manufacture and provides for easy removal of the containers therefrom.

SUMMARY OF THE INVENTION

A package for carrying containers and a method for making the package are described herein. In one exemplary embodiment, the package includes a top panel having two opposing sides and two opposing ends and a pair of side panels extending downwardly from the opposing sides of the top panel wherein the side panels define a plurality of openings. The package may also include a pair of end panels extending downwardly from the opposing ends of the top panel and two or more lower panels spanning between the end panels where each lower panel defines one or more apertures. The apertures are adapted to permit a container to partially protrude therethrough. The package may further include at least one support apparatus spanning between the end panels.

In another embodiment, the method comprises providing a blank having a plurality of panels connected by a plurality of fold lines. A plurality of containers may be placed into a first and second lower panel where the lower panels have apertures to receive the containers. A horizontal support panel intermediate the first and second lower panels may be raised to a location proximal the container flanges. At this point, a first side panel may be folded vertically upward from the first lower panel and a second side panel may be folded vertically upward from the second lower panel. A top panel may be folded horizontally away from the first side panel and attached to the second side panel and a first and second end panel may be folded vertically away from the top panel and attached to the first and second lower panels.

In another embodiment of the package, one support apparatus is positioned between each pair of adjacent lower panels. The support apparatus may comprise a pair of upwardly converging support panels each extending from a proximal edge of adjacent lower panels. In yet another embodiment, the support apparatus comprises a pair of upwardly extending support panels each extending from a proximal edge of adjacent lower panels and a horizontal support panel spanning between an opposite edge of the upwardly extending support panels. In one embodiment, the containers are tapered. In yet another embodiment, the containers have a flange.

In still yet another embodiment, a package is disclosed comprising a plurality of beverage containers arranged in a two row array wherein each container has a flange. A generally rectangular top panel having opposing sides and opposing ends is also included wherein a first and second side panel extend downwardly from the opposing sides. Each side panel may have a plurality of chime cuts through which a portion of the container flange partially protrudes. A first and second lower panel may extend inwardly from a lowermost edge of each side panel, the lower panels defining a plurality of apertures through which the container bodies partially protrude and wherein the apertures snugly retain the containers therein. The package may additionally include a pair of opposing end panels extending downwardly from the opposing ends of the top panel wherein the end panels are connected to the lower panels. A centrally located support apparatus may extend between the two rows of containers. In one embodiment, the support apparatus comprises: a generally rectangular horizontal support panel located beneath the container flanges; a first vertical support panel extending from a first edge of the horizontal support panel to a proximal edge of the first lower panel; and a second vertical support panel extending from a second edge of the horizontal support panel to a proximal edge of the second lower panel. In another embodiment, the support apparatus comprises two upwardly converging support panels extending from proximal edges of the first and second lower panels.

Accordingly, the present invention provides a wrap package for securing a plurality of containers. Advantageously, the package of the present invention permits ample surface area on the top, sides and ends of the package for product markings. In addition, the package is cost efficient to produce and permits easy removal of the containers therefrom. Furthermore, the package provides adequate package rigidity to support a plurality of containers in any number of rows.

BRIEF DESCRIPTION OF THE DRAWINGS

The invention described herein will be further characterized with reference to the drawings, wherein.

DETAILED DESCRIPTION OF THE EMBODIMENTS

In the following detailed description of the embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
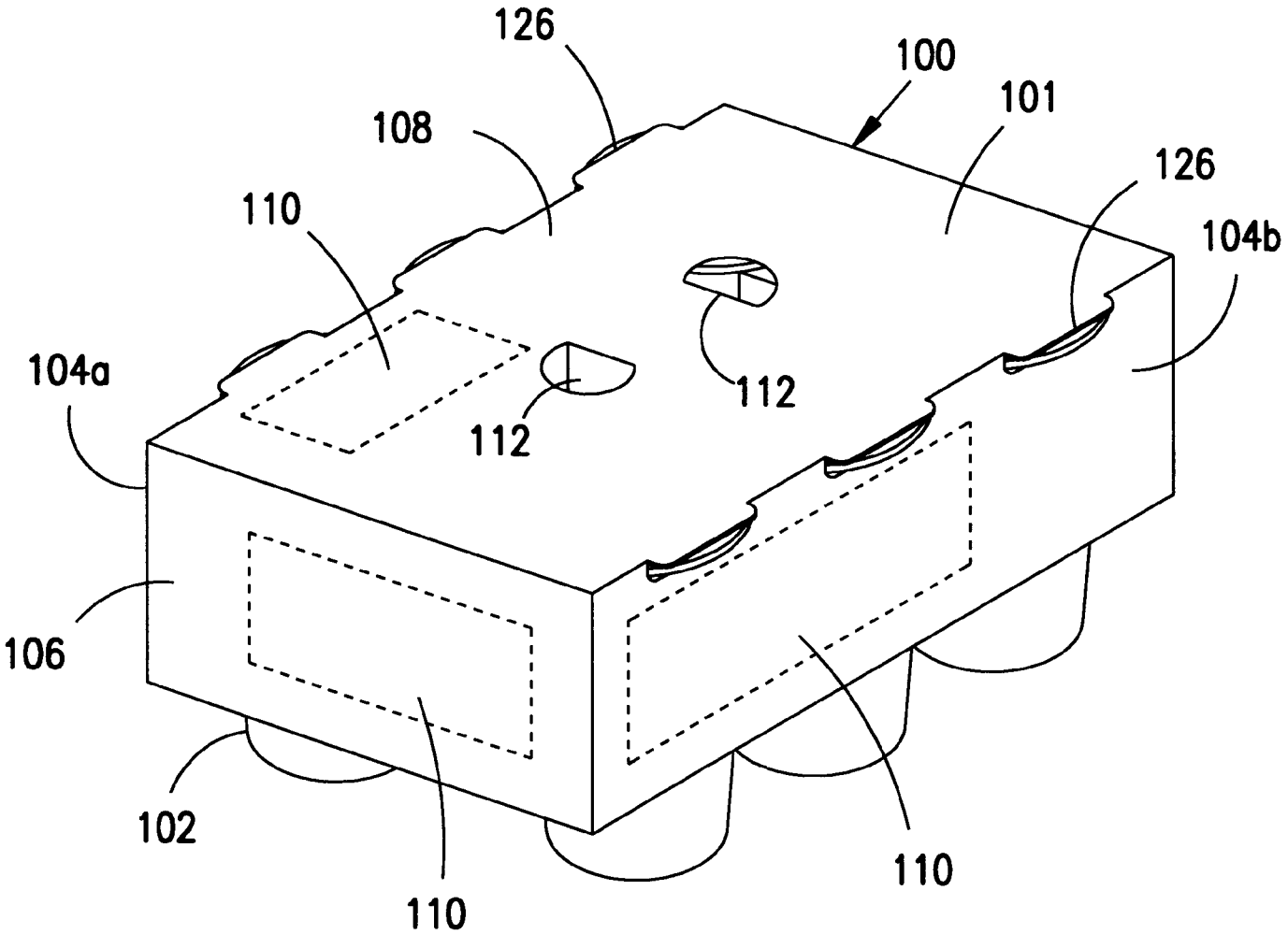
FIG. 1 is a perspective view of one exemplary embodiment of a package according to the present invention.

Referring to FIG. 1, a folding cup wrap or wrap package 100 in accordance with one embodiment of the present invention is shown. The cup wrap 100 partially encloses and secures a plurality of containers 102 for shipping and subsequent shelf display. The containers 102, in one embodiment, carry a liquid food product such as a beverage. However, the wrap package of the present invention could be used to package other food and non-food products without departing from the scope of the invention. The containers 102 extend through a lower side of the wrap 100 such that a portion of the container 102 remains visible. It is noted that terms such as "upper," "top," "lower," "bottom," and "side" are used throughout this specification only for descriptive purposes and, as such, are not intended to limit the scope of the invention in any way.

The wrap 100 may be produced from a unitary blank 101 of material (see FIG. 7) such as paperboard, although other materials may also be used. Numerous fold lines are produced on the blank by scoring or other conventional methods. The fold lines form "hinges" that permit the blank to be easily folded and configured to form the wrap package 100. Several panels are formed by the various fold lines including, in one embodiment, first and second side panels 104*a,* 104*b* (referred to generally as 104), end panels 106, and a top panel 108. Located on the top panel 108 is a pair of holes or openings 112 adapted to assist a consumer in lifting and carrying the wrap 100. When the blank 101 is folded to form the wrap 100, the panels 104, 106, and 108 are all adequately sized to accommodate various marketing indicia 110. The indicia 110 may comprise product labeling, nutritional information, directions on opening the wrap, consumer warnings, or other textual and graphic information. Advantageously, the indicia 110 are visible from any side of the wrap. That is, the indicia 110 remain visible regardless of the orientation of the wrap 100 on a store shelve.

Figure 2:
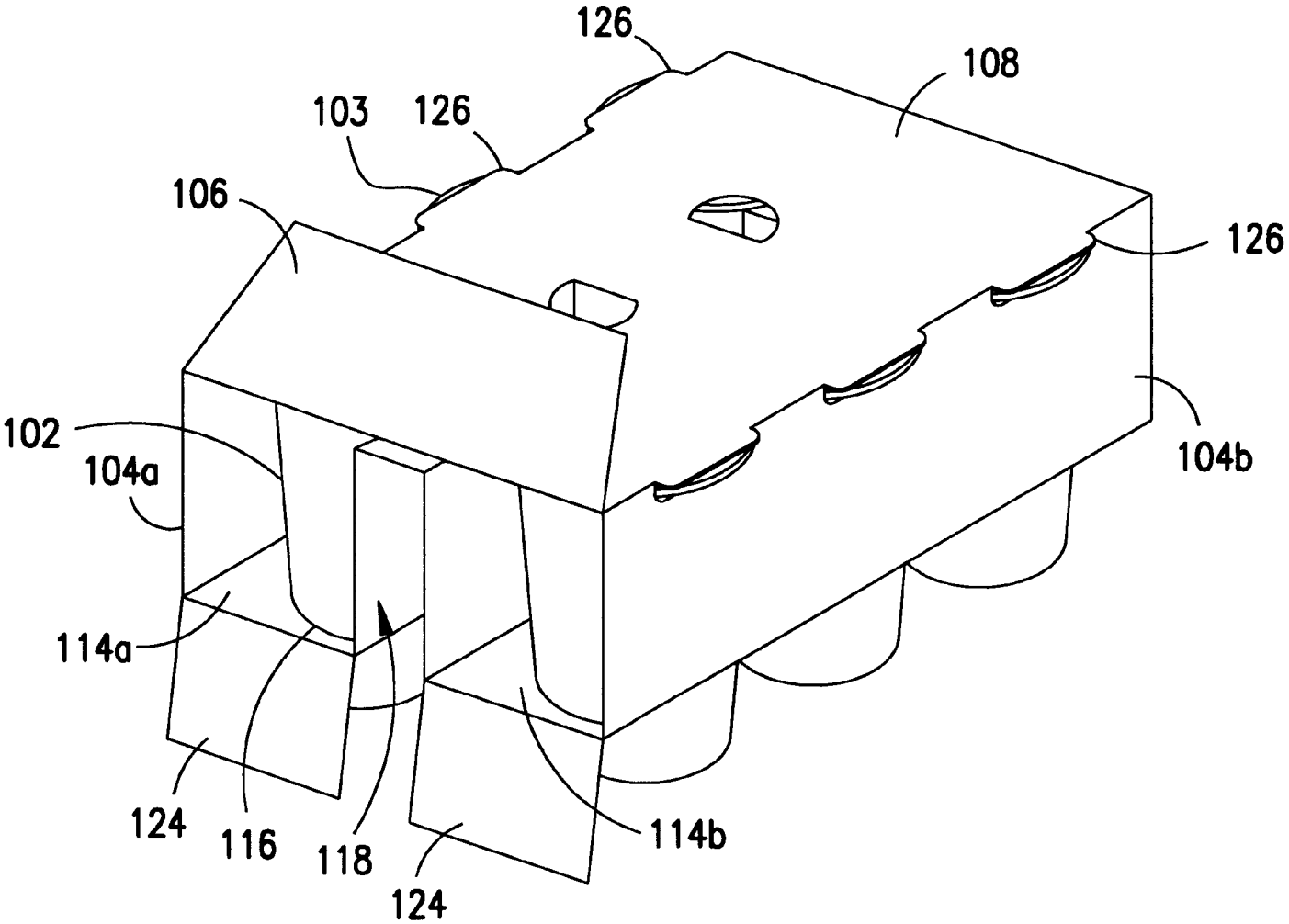
FIG. 2 is a perspective view of the package of FIG. 1 with one end opened.
Figure 3:
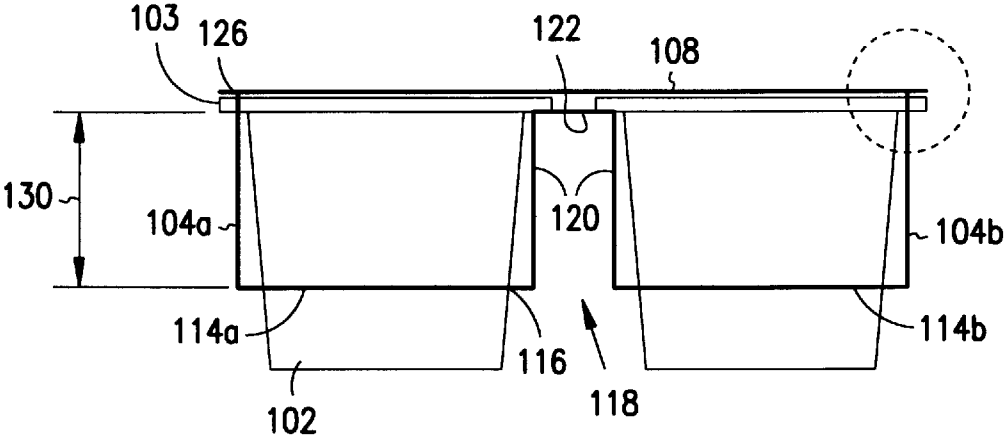
FIG. 3 is an end elevational view of the package of FIG. 1 with a portion of the package removed for clarity.

Referring generally to FIGS. 2 and 3, the structure of the wrap 100 will now be described in terms of one exemplary embodiment. In addition to the panels discussed above, the wrap 100 may further include two lower panels 114*a,* 114*b* (referred to generally as 114) extending between the end panels 106. While the embodiment shown includes two lower panels 114, wraps having other numbers of lower panels may be used without departing from the scope of the invention (e.g., three or more lower panels). The lower panels 114 include a series of die cut apertures 116 through which the containers 102 protrude. A support apparatus 118 is positioned between each pair of lower panels 114. The support apparatus 118, in one embodiment, comprises an inverted U-shaped support having a vertical or upwardly extending support panel 120 connected to a proximal edge of each adjacent lower panel 114 (see FIG. 3). Bridging between an opposite end of the support panels 120 is a horizontal support panel 122.

Figure 4:
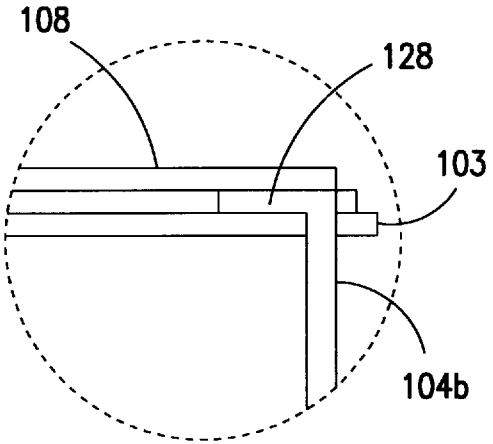
FIG. 4 is an enlarged view of a portion of the package of FIG. 3.

Referring to FIG. 2, the wrap 100 may further comprise a vertical retaining flap 124 hingedly connected to each lower panel 114. When the wrap is fully assembled, the vertical retaining flaps 124 fold upwardly and are secured or attached to the end panel 106 to enclose the wrap. As shown in FIG. 4, the blank 100, in one embodiment, is further secured in the wrap configuration with the assistance of a horizontal retaining flap 128 hingedly connected to the upper edge of the second side panel 104*b*. When the flap 128 is secured to the top panel 108 and the retaining flaps 124 are secured to the end panels 106, the wrap 100 assumes the configuration as generally shown in FIG. 1. Any of the panels described herein may include conventional opening features (e.g., integral tear strips, tab and slot, perforations, etc.) to assist in opening the package.

Having described the wrap 100, attention will now be focused on the containers 102. In one embodiment, each container 102 has a tapered body and a flanged top 103 as best shown in FIG. 3. The container flange 103, in one embodiment, is supported along the center of the wrap 100 by the support apparatus 118. The containers flanges 103 are supported opposite the support apparatus 118 by a plurality of cutouts or chime cuts 126 located along the fold lines formed by the top panel 108 and the side panels 104. The chime cuts 126 are sized to permit the container flanges 103 to partially protrude therethrough as shown in FIGS. 1, 2, and 3. Accordingly, the containers 102 are restrained from vertical motion by the sandwiching effect of the flange 103 between the top panel 108 and the support apparatus 118 (see FIG. 3) and from horizontal motion by the snug engagement of the flanges 103 with the chime cuts 126. While described herein as tapered, the containers 102, in an alternate embodiment, are straight (i.e., no taper).

Still referring to FIGS. 2 and 3, the lower portion of each container 102 is supported by the circular apertures 116 located in the lower panels 114. The apertures 116 are approximately the same diameter as the container bodies as measured at a distance 130 from the bottom of the flange (see FIG. 3). The relatively tight fit of the containers 102 within the apertures 116 restrains the lower ends of the containers from horizontal motion. Advantageously, each container 102 is tightly constrained within the package 100 and is prevented from contacting adjacent containers. Thus, damage to the containers due to contact is minimized or eliminated with the wrap of the present invention.

Figure 6:
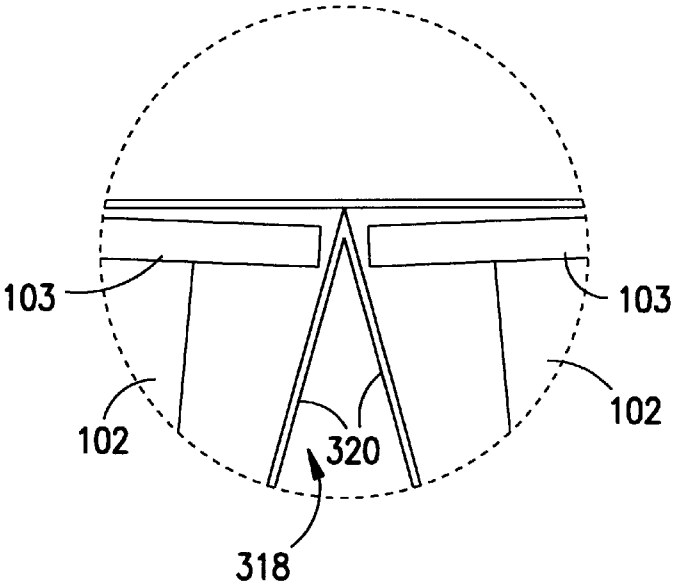
FIG. 6 is an enlarged view of a portion of the package of FIG. 5.
Figure 5:
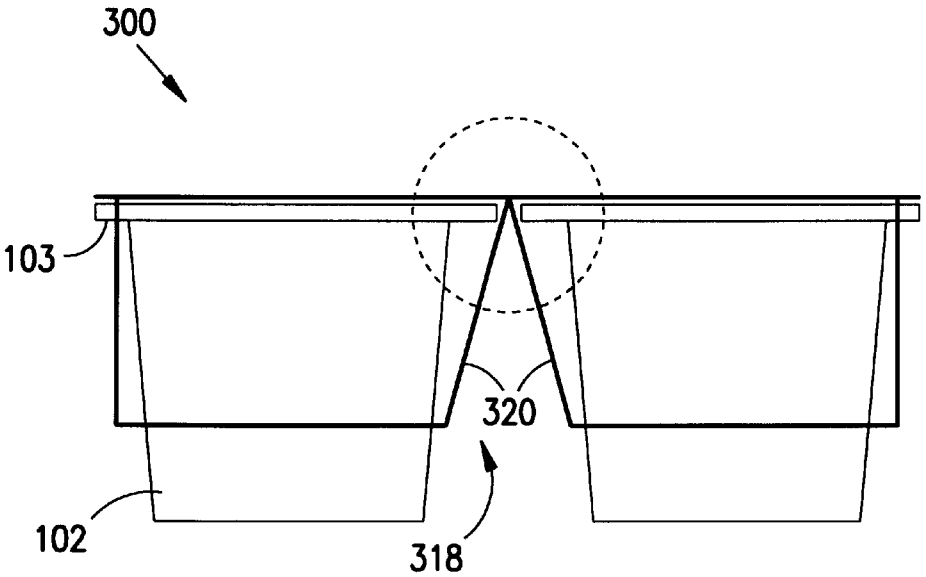
FIG. 5 is an end elevational view of another embodiment of a package according to the present invention with a portion of the package removed for clarity.

Another embodiment of the wrap package is shown in FIG. 5. Here, a wrap 300 is shown which is identical in most respects to the wrap 100 of FIGS. 1–4. However, the wrap 300 includes a support apparatus 318 comprising two upwardly converging support panels 320 forming an inverted V-shaped support instead of the inverted U-shaped support of the wrap 100. The V-shaped support apparatus 318 extends upwardly between the rows of containers as shown in FIG. 6. Since the support apparatus 318 has no horizontal support member, the container flanges 103 sit in close proximity to the support members 320. When the package 300 is lifted, the containers 102 may tilt slightly (as shown in FIG. 6) until the flange 103 contacts the support members 320. Alternatively, the wrap 300 may be sized such that the support members 320 "wedge" between the container rows during package assembly. In the case of the latter, container tilt is minimized or eliminated. The remainder of the wrap 300 construction is substantially identical to the wrap 100 and will therefore not be described in detail herein.

Figure 7:
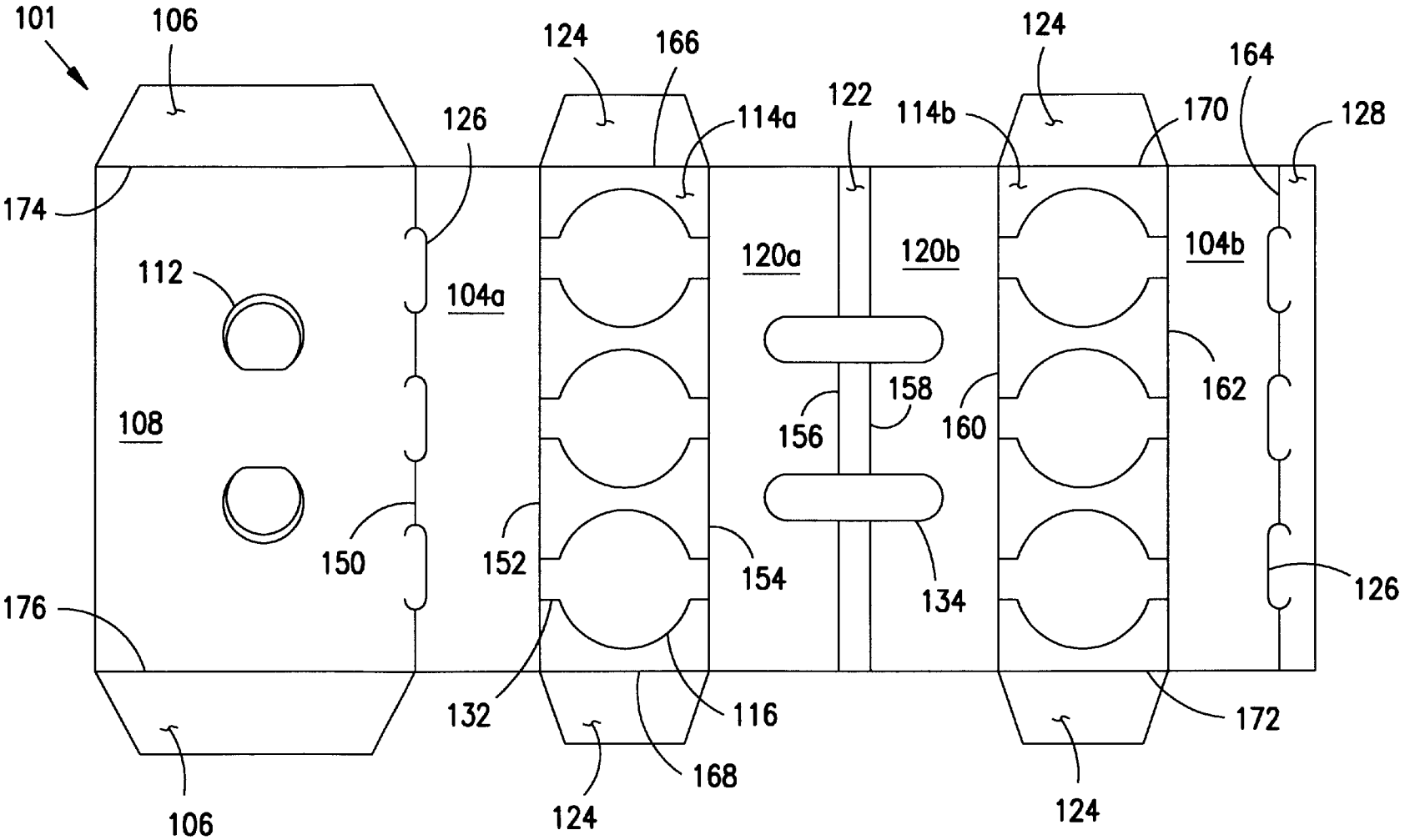
FIG. 7 is a top plan view of one embodiment of a blank according to the present invention.

Referring now to FIG. 7, one embodiment of the unitary blank 101 is shown before being folded into the wrap 100 of FIGS. 1–4. The top panel 108 is connected to the first side panel 104*a* by a first fold line 150. The chime cuts 126 are located on the first side panel 104*a* proximal the first fold line 150. Connected to the opposite edge of the side panel 104*a* along a second fold line 152 is the first lower panel 114*a*. The lower panel 114*a* includes the apertures 116 for receiving the containers. The apertures may include cutouts 132 as shown in FIG. 7. Alternatively, the apertures 116 may be circular.

The first vertical support panel 120*a* is hingedly connected to the lower panel 114*a* along a third fold line 154. Bridging between the first vertical support panel and the second vertical support panel is the horizontal support panel 122. The panel 122 is connected to the vertical support panels 120 by fourth and fifth fold lines 156 and 158. A pair of slots 134 corresponding to the openings 112 are adapted to allow insertion of the consumer's fingers beyond the horizontal support member 122.

Connected to the second vertical support panel 120*b* opposite the horizontal support panel 122 is the second lower panel 114*b*. The panel 114*b* connects to the panel 120*b* along a sixth fold line 160. The panel 114*b* is attached to the second side panel 104*b* by a seventh fold line 162. The blank terminates at the horizontal retaining flap 128 which is connected to the second side panel 104*b* along an eighth fold line 164. Chime cuts 126 are also located on the second side panel 104*b* proximal the eighth fold line 164.

The vertical retaining flaps 124 hingedly connect to respective ends of the lower panels 114*a* along ninth and tenth fold lines 166 and 168 respectively, and to the panel 114*b* along eleventh and twelfth fold lines 170 and 172 respectively. Finally, the end panels 106 connect to opposing ends of the top panel 108 at thirteenth and fourteenth fold lines 174 and 176.

Figure 8:
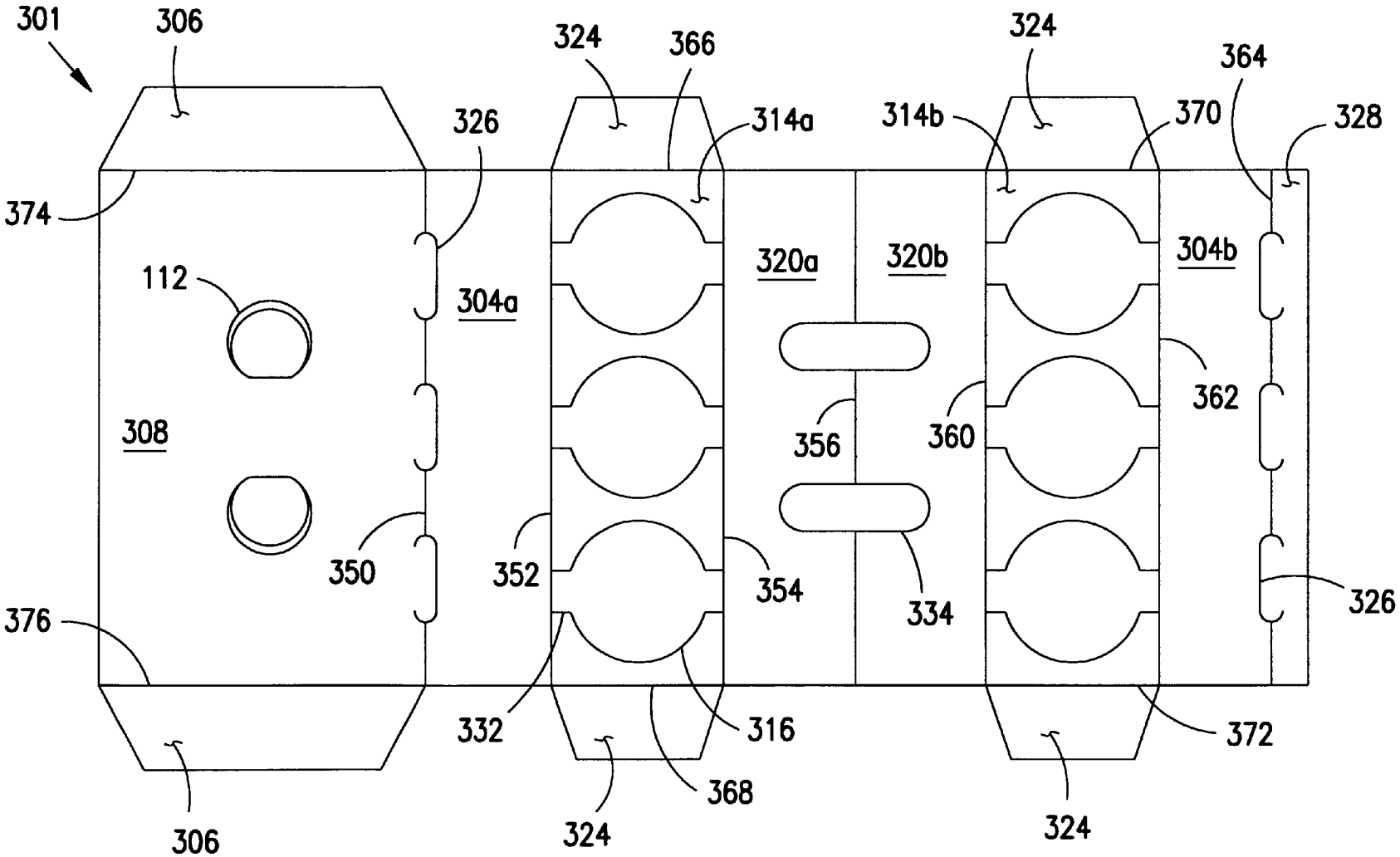
FIG. 8 is a top plan view of another embodiment of a blank according to the present invention.

FIG. 8 shows an exemplary embodiment of an alternative blank 301 used to produce the wrap 300 illustrated in FIGS. 5 and 6. The blank 301 differs from the blank 101 shown in FIG. 7 with regard to the support panels 320. That is, the support panels 320 form the inverted V-shape support apparatus 318 as shown in FIG. 5 rather than the inverted U-shape support apparatus 118 shown in FIG. 3. The blanks 101 and 301 are otherwise generally identical.

Referring still to FIG. 8, the top panel 308 is connected to the first side panel 304*a* by a first fold line 350. The chime cuts 326 are located on the first side panel 304*a* proximal the first fold line 350. Connected to the opposite edge of the side panel 304*a* along a second fold line 352 is the first lower panel 314*a*. The lower panel 314*a* includes the apertures 316 for receiving the containers. The apertures may include cutouts 332 as shown. Alternatively, the apertures 316 may be circular.

The first support panel 320*a* is hingedly connected to the lower panel 314*a* along a third fold line 354. Hingedly connected to the first support panel 320*a* along a fourth fold line 356 is the second support panel 320*b*. A pair of slots 334 corresponding to the openings 312 (when folded into the package 300) are adapted to allow insertion of the consumer's fingers beyond the support panels 320.

Connected to the second support panel 320*b* opposite the first support panel 320*a* is the second lower panel 314*b*. The panel 314*b* connects to the panel 320*b* along a fifth fold line 360. The panel 314*b* is attached to the second side panel 304*b* by a sixth fold line 362. The blank terminates at the horizontal retaining flap 328 which is connected to the second side panel 304*b* along an seventh fold line 364. Chime cuts 326 are also located on the second side panel 304*b* proximal the seventh fold line 364.

The vertical retaining flaps 324 hingedly connect to respective ends of the lower panels 314*a* along eighth and ninth fold lines 366 and 368 respectively, and to the panel 314*b* along tenth and eleventh fold lines 370 and 372 respectively. Finally, the end panels 306 connect to opposing ends of the top panel 308 at twelfth and thirteenth fold lines 374 and 376.

While described herein in terms of specific embodiments, the blanks may be constructed in various other ways. For example, the blank could be split along another fold line. In addition, blanks having additional rows and support apparatuses are also possible (e.g., a package with two lower panels would use one support apparatus, a package with three lower panels would use two, etc.). Thus, the embodiments described herein are exemplary only.

A method for packaging a plurality of containers in the wrap package 100 in accordance with one embodiment of the invention will now be described. The order of the steps may be rearranged to some degree to better accommodate manufacturing processes. Frequent reference is made to various fold lines in the following discussion. The reader is referred to FIG. 7 for illustration of these references. For simplicity, the packaging method will be discussed in terms of packing six containers in a three by two array. However, as previously mentioned, other numbers of containers and other numbers of rows can be accommodated with slight modifications to the wrap without departing from the scope of the invention.

Figure 9A:
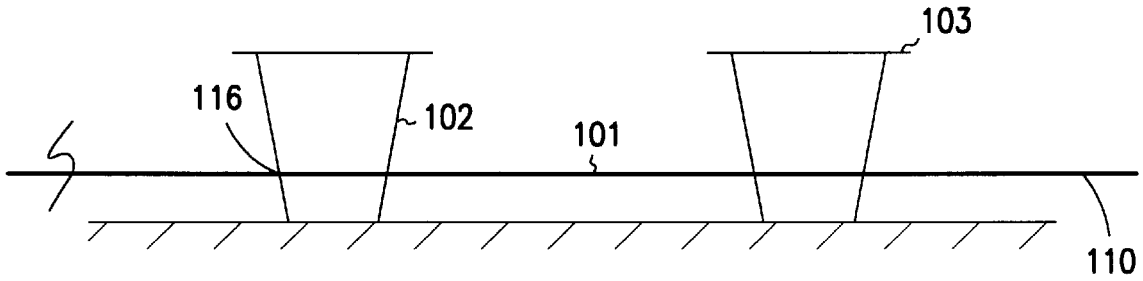
FIGS. 9A–9D are schematic elevational views illustrating a method for packaging a plurality of containers according to one embodiment of the present invention.
Figure 9B:
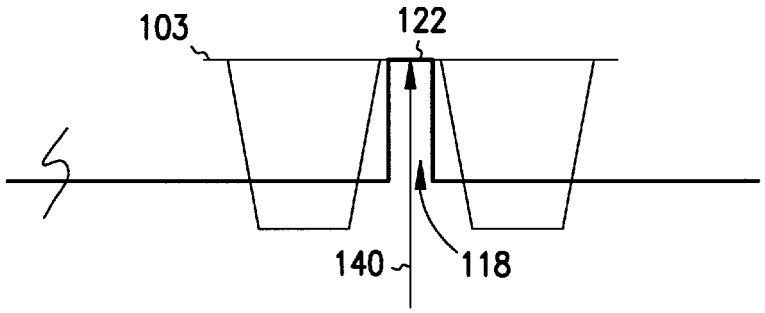

Referring to FIG. 9A, the containers 102 are, in one embodiment, positioned into the die cut apertures 116 of the blank 101. The blank 101 is of course first printed with the desired indicia 110 on its outer surface as represented in FIG. 1. A static guide or rotating wheel (not shown) applies an upward force 140 to raise the support apparatus 118 as shown in FIG. 9B. To raise the support apparatus, the blank 101 is folded along fold lines 154, 156, 158, and 160 (see FIG. 7). The formation of the support apparatus 118 draws the rows of containers 102 toward each other and places the horizontal support panel 122 directly beneath the container flange 103 as shown in FIG. 9B.

Figure 9C:
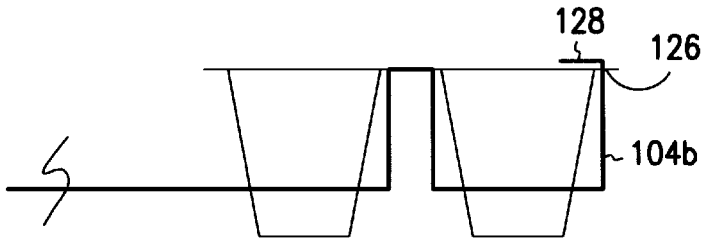
Figure 9D:
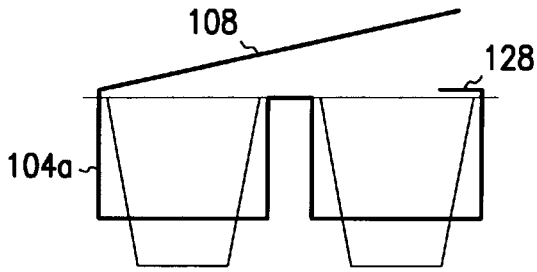

From this point, the side panel 104*b* is folded vertically upward as shown in FIG. 9C along the fold line 162. The horizontal retaining flap 128 is likewise folded over the containers along fold line 164. Thus, the container flanges 103 are trapped within the chime cuts 126. The opposing side panel 104*a* may then be folded vertically along fold line 152 as shown in FIG. 9D and the top panel 108 may be folded horizontally over the container tops along fold line 150. An adhesive may be applied between the horizontal retaining member 128 and the top panel 108 to secure the wrap in the configuration generally represented in FIG. 2. Finally, the vertical retaining flaps 124 (see FIG. 2) may be folded vertically upward and the end panels 106 may be folded vertically downward and secured to the flaps 124 with an adhesive to arrive at the wrap illustrated in FIG. 1. While described herein as an adhesive, other securing means can be used without departing from the scope of the invention. For instance, mechanical fastening (e.g., stapling) may be used. Alternatively, the wrap may have interengaging features (e.g., tab and slot arrangements) that retain the wrap in its proper configuration.

Referring now to FIGS. 10A–10D, a method for packaging a plurality of containers in the wrap package 300 in accordance with one embodiment of the invention will now be described. Once again, the order of the steps may be rearranged to some degree to better accommodate manufacturing processes. The reader is referred to FIG. 8 for illustration of the references made to various fold lines in the following discussion. For simplicity, the packaging method will be discussed in terms of packing six containers in a three by two array. However, as previously mentioned, other numbers of containers and other numbers of rows can be accommodated with slight modifications to the method and wrap without departing from the scope of the invention.

Figure 10A:
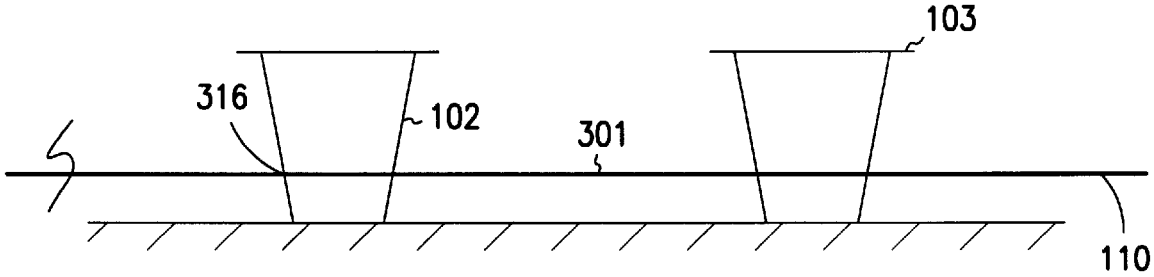
FIGS. 10A–10D are schematic elevational views illustrating a method for packaging a plurality of containers according to another embodiment of the present invention.
Figure 10B:
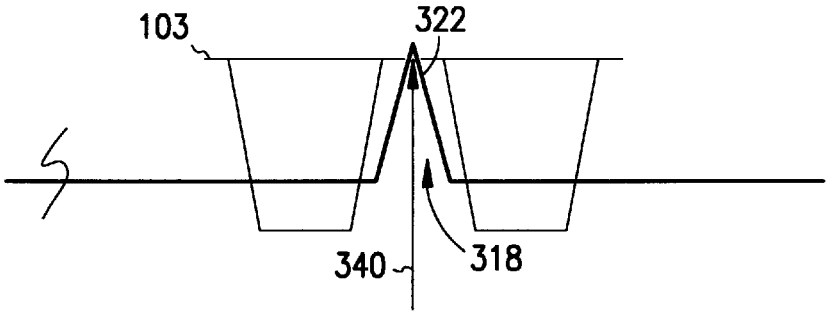

Referring first to FIG. 10A, the containers 102 are, in one embodiment, positioned into the die cut apertures 316 of the blank 301. The blank 301 is of course first printed with the desired indicia 110 on its outer surface as represented in FIG. 1. A static guide or rotating wheel (not shown) applies an upward force 340 to raise the support apparatus 318 as shown in FIG. 10B. To raise the support apparatus, the blank 301 is folded along fold lines 354, 356, and 360 (see FIG. 8). The formation of the support apparatus 318 draws the rows of containers 102 toward each other and places the support panels 322 in proximity to the container flange 103 as shown in FIG. 10B.

Figure 10C:
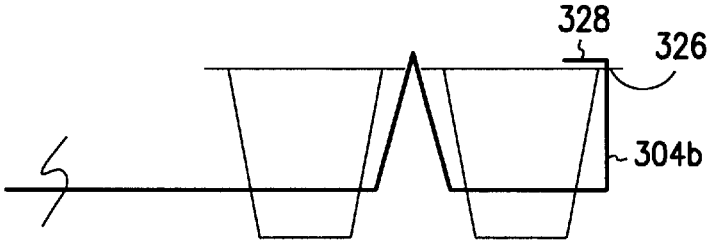
Figure 10D:
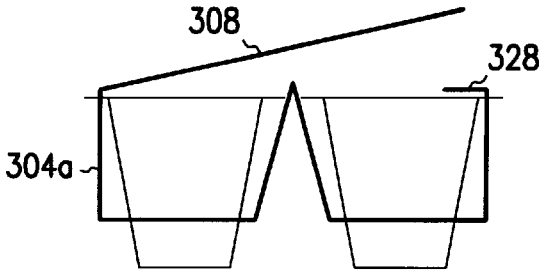

From this point, the side panel 304*b* is folded vertically upward as shown in FIG. 10C along the fold line 362. The horizontal retaining flap 328 is likewise folded over the containers along fold line 364. Thus, the container flanges 103 are trapped within the chime cuts 326. The opposing side panel 304*a* may then be folded vertically along fold line 352 as shown in FIG. 10D and the top panel 308 may be folded horizontally over the container tops along fold line 350. An adhesive may be applied between the horizontal retaining member 328 and the top panel 308 to secure the wrap in the configuration generally represented in FIG. 2. Finally, the vertical retaining flaps 324 (see FIG. 8) may be folded vertically upward and the end panels 306 may be folded vertically downward and secured to the flaps 324 with an adhesive to arrive at the wrap illustrated in FIG. 1. As previously mentioned, other securing means (e.g., stapling, tab and slot arrangements, etc.) can also be used without departing from the scope of the invention.

Figure 11:
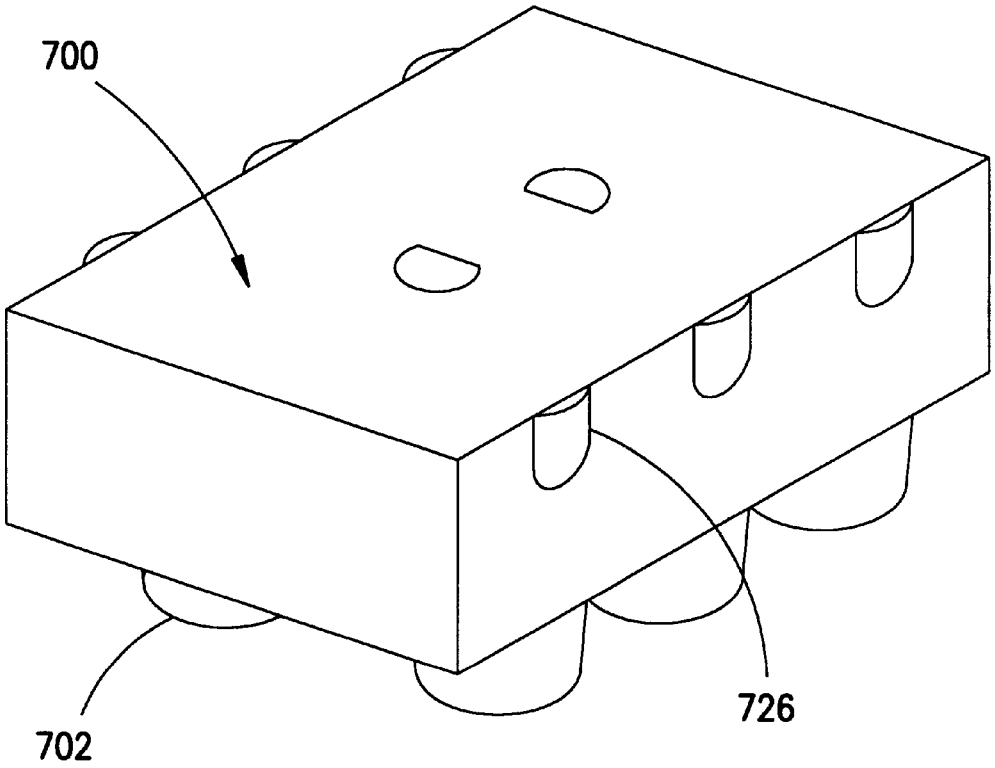
FIG. 11 is a perspective view of yet another embodiment of a package according to the present invention.

FIG. 11 illustrates a wrap 700 according to yet another embodiment of the present invention. While the wraps discussed above are adapted for use with flanged containers, The wrap 700 may support a plurality of flangeless containers 702 in a manner similar to that illustrated in FIGS. 5 and 6. However, the wrap 700 replaces the chime cut 126 with a larger cutout 726 adapted to restrain the container 702 by permitting a portion of the container body to protrude through the cutout. In one embodiment, the cutout 726 forms a semi-elliptical shape.

Figure 12:
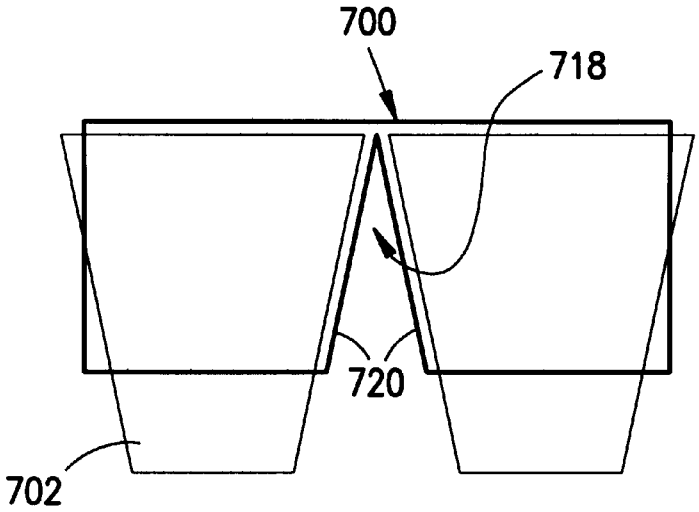
FIG. 12 is an end elevational view of the package of FIG. 11 with a portion of the package removed for clarity.

Referring now to FIG. 12, an end view of the wrap package 700 is shown. The flangeless containers 702 are supported along their interior edge by a support apparatus 718 comprising two upwardly converging support panels 720. The panels 720 are generally congruent to the taper of the container walls to increase contact therebetween. However, in another embodiment, the panels may be oriented at an angle different than the container taper. The construction of the wrap 700 is otherwise similar to the wraps 100 and 300 already described herein.

Accordingly, the present invention provides a wrap package for securing a plurality of containers. Advantageously, the package of the present invention permits ample surface area on the top, sides and ends of the package for product markings. In addition, the package is cost efficient to produce and permits easy removal of the containers therefrom. Furthermore, the package provides adequate package rigidity to support a plurality of containers packaged in any number of rows.

Exemplary embodiments of the present invention are described above. Those skilled in the art will recognize that many embodiments are possible within the scope of the invention. Variations, modifications, and combinations of the various parts and assemblies can certainly be made and still fall within the scope of the invention. Thus, the invention is limited only by the following claims, and equivalents thereto.

What is claimed is:

1. A package for carrying containers, comprising:

a top panel having two opposing sides and two opposing ends;

a pair of side panels extending downwardly from the opposing sides of the top panel, the side panels defining a plurality of openings;

a pair of end panels extending downwardly from the opposing ends of the top panel;

two or more lower panels spanning between the end panels, each lower panel defining one or more apertures adapted to permit a container to partially protrude therethrough; and at least one support apparatus spanning between the end panels.

2. The package of claim 1, wherein the plurality of openings are adapted to permit the containers to partially protrude therethrough.

3. The package of claim 1, wherein the support apparatus is connected to the lower panels and is adapted to support the containers.

4. The package of claim 1, wherein the top panel, the side panels, the end panels, the lower panels, and the support apparatus are formed from a unitary blank of material.

5. The package of claim 4, wherein the unitary blank of material comprises paperboard.

6. The package of claim 1, wherein the top panel further comprises one or more holes to assist in lifting and carrying the package.

7. The package of claim 3, wherein one support apparatus is positioned between each pair of adjacent lower panels.

8. The package of claim 7 wherein the support apparatus comprises a pair of upwardly converging support panels each extending from a proximal edge of adjacent lower panels.

9. The package of claim 7, wherein the support apparatus comprises a pair of upwardly extending support panels each extending from a proximal edge of adjacent lower panels; and a horizontal support panel spanning between an opposite edge of the upwardly extending support panels.

10. A package for carrying tapered containers, the package comprising:

a top panel having two opposing sides and two opposing ends;

a pair of side panels extending downwardly from the opposing sides of the top panel;

a pair of end panels extending downwardly from the opposing ends of the top panel;

two or more lower panels spanning between the end panels, the lower panels defining one or more apertures adapted to permit the containers to partially protrude therethrough; and at least one support apparatus spanning between the end panels intermediate each pair of adjacent lower panels, wherein the support apparatus comprises a pair of upwardly converging support panels connected to proximal edges of adjacent lower panels.

11. The package of claim 10, wherein the support panels are substantially congruent to the tapered containers.

12. The package of claim 10, wherein the side panels further define a series of semi-elliptical cutouts adapted to retain the containers.

13. The package of claim 10, wherein the top panel, side panels, lower panels, end panels, and support apparatus are all fabricated from a unitary blank of material.

14. A package for carrying flanged containers, the package comprising:

a top panel having two opposing sides and two opposing ends;

a pair of side panels extending downwardly from the opposing sides of the top panel wherein the side panels define a plurality of chime cuts each adapted to receive a container flange;

a pair of end panels extending downwardly from the opposing ends of the top panel;

two or more lower panels spanning between the end panels, the lower panels defining one or more apertures adapted to permit the containers to partially protrude therethrough; and at least one support apparatus spanning between the end panels intermediate each pair of adjacent lower panels, wherein the support apparatus comprises a pair of upwardly converging support panels connected to proximal edges of adjacent lower panels.

15. The package of claim 14, wherein the support apparatus is adapted to engage a portion of each container flange.

16. The package of claim 14, wherein the top panel, side panels, lower panels, end panels, and support apparatus are all fabricated from a unitary blank of material.

17. A package for carrying flanged containers, the package comprising:

a top panel having two opposing sides and two opposing ends;

a pair of side panels extending downwardly from the opposing sides of the top panel wherein the side panels define a plurality of chime cuts each adapted to receive a container flange;

a pair of end panels extending downwardly from the opposing ends of the top panel;

two or more lower panels spanning between the end panels, the lower panels defining one or more apertures adapted to permit the containers to partially protrude therethrough; and at least one support apparatus spanning between the end panels intermediate each pair of adjacent lower panels, wherein the support apparatus comprises: a pair of support panels wherein one support panel extends upwardly from a proximal edge of each adjacent lower panel; and a horizontal support panel spanning between an opposite edge of each support panel.

18. The package of claim 17, wherein the horizontal support panel is adapted to support a portion of the container flanges.

19. The package of claim 17, wherein the top panel, side panels, lower panels, end panels, and support apparatus are all fabricated from a unitary blank of material.

20. A package comprising:

a plurality of beverage containers arranged in a two row array wherein each container has a flange;

a generally rectangular top panel having opposing sides and opposing ends;

a first and second side panel extending downwardly from the opposing sides, each side panel having a plurality of chime cuts through which a portion of the container flange partially protrudes;

a first and second lower panel extending inwardly from a lowermost edge of each side panel, the lower panels defining a plurality of apertures through which the container bodies partially protrude and wherein the apertures snugly retain the containers therein;

a pair of opposing end panels extending downwardly from the opposing ends of the top panel wherein the end panels are connected to the lower panels; and a centrally located support apparatus extending between the two rows of containers wherein the support apparatus contacts the container flanges at a location generally opposite the chime cuts.

21. The package of claim 20 wherein the support apparatus comprises:

a generally rectangular horizontal support panel located beneath the container flanges;

a first vertical support panel extending from a first edge of the horizontal support panel to a proximal edge of the first lower panel; and a second vertical support panel extending from a second edge of the horizontal support panel to a proximal edge of the second lower panel.

22. The package of claim 20 wherein the support apparatus comprises two upwardly converging support panels extending from proximal edges of the first and second lower panels.

23. The package of claim 20 wherein the top panel defines one or more openings to assist in lifting and carrying the package.

24. The package of claim 23 wherein the support apparatus further comprises slots aligned with the openings to further assist in lifting and carrying the package.

25. The package of claim 20 wherein each lower panel further comprises a pair of opposing vertical retaining flaps coextensive with the end panels.

26. The package of claim 25 wherein the second side panel further comprises a horizontal retaining flap coextensive with the top panel.

27. The package of claim 26 further comprising means to secure the vertical retaining flaps to the end panels and the horizontal retaining flap to the top panel.

28. The package of claim 27 wherein the means to secure comprises an adhesive applied to the mating surfaces of the respective flaps and panels.

29. The package of claim 20 further comprising indicia on one or more of the top panel, the side panels, and the end panels.

30. A unitary material blank for forming a wrap package for a plurality of containers in a two row array wherein each container has a flanged end, comprising:

a generally rectangular top panel having first and second opposing sides and first and second opposing ends;

a first side panel connected to the first side of the top panel at a first fold line, the first side panel including a first plurality of chime cuts wherein each chime cut of the first plurality of chime cuts is adapted to receive a portion of a container flange from a first row of containers;

a first lower panel connected to the first side panel by a second fold line, the first lower panel defining a first plurality of apertures adapted to receive the first row of containers;

a first vertical support panel connected to the first lower panel by a third fold line;

a horizontal support panel connected to the first vertical support panel by a fourth fold line;

a second vertical support panel connected to the horizontal support panel by a fifth fold line;

a second lower panel connected to the second vertical support panel by a sixth fold line, the second lower panel defining a second plurality of apertures adapted to receive a second row of containers, the second lower panel being substantially identical to the first lower panel, wherein the first and second vertical support panels and the horizontal support panel are adapted to form an inverted U-shaped support apparatus between the first and second lower panels;

a second side panel connected to the second lower panel by a seventh fold line, the second side panel including a second plurality of chime cuts wherein each chime cut of the second plurality of chime cuts is adapted to receive a portion of a container flange from the second row of containers;

a horizontal retaining flap connected to the second side panel by an eighth fold line;

a first pair of vertical retaining flaps connected to opposite ends of the first lower panel by ninth and tenth fold lines;

a second pair of vertical retaining flaps connected to opposite ends of the second lower panel by eleventh and twelfth fold lines; and a pair of end panels connected to the first and second ends of the top panel along thirteenth and fourteenth fold lines.

31. The blank of claim 30 further comprising means for securing the horizontal retaining flap to the second side of the top panel and the first and second pairs of vertical retaining flaps to their respective end panels.

32. The blank of claim 31 wherein the means for securing comprises an adhesive applied to the mating surfaces of the respective flaps and panels.

33. The blank of claim 32 wherein the top panel further defines openings to assist in lifting and carrying the package.

34. The blank of claim 33 wherein the first and second vertical support panels and the horizontal support panel further define slots so that, when the package is assembled, the slots align with the openings to further assist in lifting and carrying the package.

35. The blank of claim 30 wherein the blank comprises paperboard.

36. A unitary material blank for forming a wrap package for a plurality of containers arranged in a two row array, comprising:

a generally rectangular top panel having first and second opposing sides and first and second opposing ends;

a first side panel connected to the first side of the top panel at a first fold line, the first side panel including a first plurality of cutouts wherein each cutout of the first plurality of cutouts is adapted to receive a portion of one container from a first row of containers;

a first lower panel connected to the first side panel by a second fold line, the first lower panel defining a first plurality of apertures adapted to receive the first row of containers;

a first support panel connected to the first lower panel by a third fold line;

a second support panel connected to the first support panel by a fourth fold line;

a second lower panel connected to the second support panel by a fifth fold line, the second side panel including a second plurality of cutouts wherein each cutout of the second plurality of cutouts is adapted to receive a portion of one container from a second row of containers; the second lower panel being substantially identical to the first lower panel, wherein the first and second support panels are adapted to form an inverted V-shaped support apparatus between the first and second lower panels;

a second side panel connected to the second lower panel by a sixth fold line, the second side panel including a second plurality of cutouts wherein each cutout of the second plurality of cutouts is adapted to receive a portion of a container from the second row of containers;

a horizontal retaining flap connected to the second side panel by a seventh fold line;

a first pair of vertical retaining flaps connected to opposite ends of the first lower panel by eighth and ninth fold lines;

a second pair of vertical retaining flaps connected to opposite ends of the second lower panel by tenth and eleventh fold lines; and a pair of end panels connected to the first and second ends of the top panel along twelfth and thirteenth fold lines.

37. The blank of claim 36 further comprising means for securing the horizontal retaining flap to the second side of the top panel and the first and second pairs of vertical retaining flaps to their respective end panels.

38. The blank of claim 37 wherein the means to secure comprises an adhesive applied to the mating surfaces of the respective flaps and panels.

39. The blank of claim 36 wherein the top panel further defines openings to assist in lifting and carrying the package.

40. The blank of claim 39 wherein the first and second support panels further define slots so that, when the package is assembled, the slots align with the openings to further assist in lifting and carrying the package.

41. The blank of claim 36 wherein the blank comprises paperboard.

42. The blank of claim 36 wherein the first and second plurality of cutouts comprise chime cuts each adapted to receive a portion of a container flange.

43. The blank of claim 36 wherein the first and second plurality of cutouts comprise semi-elliptical openings adapted to receive a portion of the containers.

44. A method for forming a package for carrying a plurality of flanged containers, the method comprising:

providing a blank having a plurality of panels connected by a plurality of fold lines;

placing a plurality of containers into a first and second lower panel, the lower panels having apertures to receive the containers;

raising a horizontal support panel intermediate the first and second lower panels to a location proximal the container flanges;

folding a first side panel vertically upward from the first lower panel;

folding a second side panel vertically upward from the second lower panel;

folding a top panel horizontally away from the first side panel;

attaching the top panel to the second side panel;

folding a first and second end panel vertically away from the top panel; and attaching the first and second end panels to the first and second lower panels.

45. The method of claim 44 wherein attaching the first and second end panels further comprises:

folding a vertical retaining flap vertically upward from each end of each lower panel;

folding the first and second end panels vertically downward from the top panel; and securing the vertical retaining flaps to the first and second end panels.

46. The method of claim 44, wherein attaching the top panel to the second side panel further comprises:

folding a horizontal retaining flap away from the second side panel; and securing the horizontal retaining flap to the top panel.

47. A method for forming a package for carrying a plurality of containers, the method comprising:

providing a blank having a plurality of panels connected by a plurality of fold lines;

placing a plurality of containers into a first and second lower panel, the lower panels having apertures to receive the containers;

raising a first and second support panel intermediate the first and second lower panels to form an inverted V-shaped support;

folding a first side panel vertically upward from the first lower panel;

folding a second side panel vertically upward from the second lower panel;

folding a top panel horizontally away from the first side panel;

attaching the top panel to the second side panel;

folding a first and second end panel vertically away from the top panel; and attaching the first and second panels to the first and second lower panels.

48. The method of claim 47 wherein attaching the first and second end panels further comprises:

folding a vertical retaining flap vertically upward from each end of each lower panel;

folding the first and second end panels vertically downward from the top panel; and securing the vertical retaining flaps to the first and second end panels.

49. The method of claim 47, wherein attaching the top panel to the second side panel further comprises:

folding a horizontal retaining flap away from the second side panel; and securing the horizontal retaining flap to the top panel.

* * * * *